US006923705B2

(12) United States Patent
DeSalvo et al.

(10) Patent No.: US 6,923,705 B2
(45) Date of Patent: Aug. 2, 2005

(54) PLAY STRUCTURE AND STRUCTURAL BUILDING ELEMENTS FOR BUILDING A PLAY STRUCTURE

(75) Inventors: John Anthony DeSalvo, Las Vegas, NV (US); Anthony J. Preus, Las Vegas, NV (US)

(73) Assignee: Kidzbuilt, LLC, Las Vegas, NV (US)

( * ) Notice: Subject to any disclaimer, the term of this patent is extended or adjusted under 35 U.S.C. 154(b) by 0 days.

(21) Appl. No.: 10/356,316

(22) Filed: Jan. 31, 2003

(65) Prior Publication Data

US 2003/0203703 A1 Oct. 30, 2003

Related U.S. Application Data

(60) Provisional application No. 60/360,547, filed on Feb. 28, 2002.

(51) Int. Cl.[7] ..... A63H 33/08

(52) U.S. Cl. ..... 446/106; 446/108; 446/115; 446/124; 52/233

(58) Field of Search ..... 446/106, 108, 446/111–115, 118, 119, 124, 125, 128; 52/82, 646, 656.9, 233

(56) References Cited

U.S. PATENT DOCUMENTS

| | | | | | |
|---|---|---|---|---|---|
| 1,287,771 | A | | 12/1918 | Schmitt | |
| 1,351,086 | A | | 8/1920 | Wright | |
| 1,510,326 | A | | 9/1924 | Locke | |
| 1,946,250 | A | * | 2/1934 | Whaley | 446/76 |
| 2,059,598 | A | | 11/1936 | Paulson | |
| 2,088,874 | A | * | 8/1937 | Schauer | 446/108 |
| 2,125,580 | A | * | 8/1938 | Paulson | 446/122 |
| 2,238,039 | A | * | 4/1941 | De Witt | 446/110 |
| 2,635,303 | A | | 4/1953 | Poynter | |
| 4,270,304 | A | | 6/1981 | Sofer | |
| 4,372,076 | A | * | 2/1983 | Beck | 446/106 |
| 4,521,203 | A | | 6/1985 | Rothenberg, Jr. | |
| 5,145,440 | A | | 9/1992 | Boris et al. | |
| 5,706,613 | A | | 1/1998 | Drake, Jr. et al. | |
| 5,853,313 | A | | 12/1998 | Zheng | |
| 6,059,630 | A | * | 5/2000 | Paxton et al. | 446/106 |
| 6,146,232 | A | * | 11/2000 | Robbins | 446/106 |
| 6,189,271 | B1 | | 2/2001 | Christensen | |
| 6,312,305 | B1 | | 11/2001 | McCormick et al. | |
| 6,554,677 | B2 | * | 4/2003 | Leemon | 446/122 |

* cited by examiner

*Primary Examiner*—Bena Miller
(74) *Attorney, Agent, or Firm*—Robert Ryan Morishita; Anderson & Morishita, LLC

(57) ABSTRACT

Building elements for constructing a play structure comprise polyethylene members. In one embodiment, the members are extruded cylinders and include notches or other interlocking features. In another embodiment, the members are flat panels and include notches, teeth, apertures or other interlocking features. A play structure comprises a plurality of the building elements connected to one another. In one embodiment, the play structure comprises a cabin. Walls of the cabin are constructed by interlocking elongate wall elements. The cabin includes a roof constructed from interlocked flat panels or slats. A roof support elevates the roof over the walls and connects the roof to the walls. A method of constructing a play structure comprises assembling a plurality of the building elements.

15 Claims, 3 Drawing Sheets

PLAY STRUCTURE AND STRUCTURAL BUILDING ELEMENTS FOR BUILDING A PLAY STRUCTURE

RELATED APPLICATION DATA

This application claims priority to U.S. Provisional Application Ser. No. 60/360,547 filed Feb. 28, 2002.

FIELD OF THE INVENTION

The present invention relates to play structures of the type which children may play in and which may be assembled from a plurality of structural building elements.

BACKGROUND OF THE INVENTION

Children enjoy playing in small structures such as playhouses. These structures may come in a variety of shapes and sizes. Generally, playhouses are sized for children and are thus much smaller than a structure which would house an adult. For example, a playhouse may only be 4–6 feet tall, and 4–15 feet wide and long. These structures thus provide an intimate play environment for children.

The playhouses may be constructed from a wide variety of materials. Commonly, playhouses which are located outside are wood frame structures having siding and a waterproof roof, such as a shingled roof. Now, playhouses are often constructed of hard molded plastic. These playhouses are often modular, having four connected wall panels and an overlying roof.

These playhouse structures have a number of significant drawbacks. First, as is known, one of the most enjoyable activities for children is assembling or building play structures. A common past time for children is constructing forts. These forts may be constructed from cardboard boxes, such as refrigerator or washer/dryer boxes. Alternatively, children often drape blankets over tables and chairs to form an enclosed play structure.

A child's construction of these structures can have a number of benefits. Building these structures contributes to a child's development and learning. The construction of these structures substantially contributes to the development of a child's problem solving skills. The child must determine how to assemble a large number of individual elements, such as chairs and blankets, to form a single structure. In addition, the child must determine how to connect the blankets, such as by anchoring them to keep them in place.

A disadvantage to the playhouses described above is that they do not contribute to the development of these skills. Wood playhouses required substantial construction skill, and are completed by adults. Plastic playhouses are constructed of but a few elements which are generally difficult to assemble. Further, the size of the elements, such as a single wall panel, is such that they are very heavy and can not be moved by a child. In addition, once assembled, these structures are generally not designed to be taken apart.

Another problem with these structures is that they are and not easily stored. An assembled wooden play structure is very rigid and heavy, and must generally be left in one spot for the duration of its use. Some attempts have been made to create an easily stored playhouse, but these structure suffer from other problems. For example, some playhouses have been developed which comprise a fabric material stretched over a wire frame. The wire frame is collapsible so that the structure may be stored in a coiled, flat position. The problem with these structures is that they are often very difficult to set up, requiring that the structure be "uncoiled" and then popped-up. Further, the structure comprises a single element, so that the structure suffers from the above-stated drawback that it can't be used to develop a child's skills.

Yet another problem with the play house structures is that they often require a substantial amount of maintenance. For example, a wooden playhouse must be painted and the roof maintained so that the structure does not rot and deteriorate.

An improved play structure and improved building elements from which a play structure can be constructed are desired.

SUMMARY OF THE INVENTION

The present invention comprises structural building elements for use in building a play structure, a method of building or assembling a play structure, and an assembled play structure.

One embodiment of the invention comprises a structural building element for use in building a play structure. Preferably, the building element comprises a member constructed of expanded polyethylene, the member including at least one interlocking feature permitting connection of the member to another member.

In one embodiment, the member is extruded and has a substantially cylindrical shape. The interlocking feature may comprise at least one notch formed in the member. In another embodiment, the member is a substantially planar panel.

One embodiment of the invention comprises a play structure constructed from a plurality of building elements. The elements include a plurality of wall elements, the wall elements comprising generally elongate cylindrical members, the members comprising extruded polyethylene and the wall elements connectable to form at least two upstanding walls of a structure. The elements also include a plurality of generally planar roof slats for use in forming a roof, the slats constructed of expanded polyethylene, and at least two roof supports, the roof supports constructed of expanded polyethylene. In addition, means are provided for connecting one or more of the wall elements to one another to form the walls, means are provided for connecting one or more of the roof slats to one another, means are provided for connecting the roof slats to the roof supports, and means are provided for connecting the roof supports to the walls, whereby a play structure may be created having upwardly extending walls and a roof, the walls and roof defining an interior area of the structure within which a child may play.

In one embodiment, the means for connecting the wall elements comprise at least one notch formed at least two of the wall elements. In another embodiment, the means for connecting the wall elements comprise at least one interlocking link, at least two of the wall elements having at least one notch formed therein and the at least one interlocking link having at least one notch formed therein, a notch on the interlocking link engageable with a notch on the wall element.

In one embodiment, the means for connecting one or more of the roof slats comprises at least one tooth extending from one roof slat for engagement with at least one notch formed in another roof slat. The means for connecting the roof slats to the supports comprises at least one tooth extending outwardly from the at least one of the roof supports for engagement with at least one aperture formed in one of the roof slats.

In one embodiment, the play structure has the form of a cabin, and has three walls formed from the wall elements, the walls comprising a pair of spaced side walls and an end wall, the side walls extending generally perpendicular to the end wall. The cabin has an open front and a covering roof. In addition, in one embodiment, the cabin includes a chimney, the chimney comprising four wall elements connected to one another, the chimney connectable to one or more of the roof slats.

In other embodiments of the invention, the play structure has other forms, such as a castle, igloo, fire station or other forms.

One embodiment of the invention is a method of constructing a play structure. In one embodiment, the method includes the step of forming at least two upwardly extending walls, each wall formed from a plurality of wall elements arranged vertically, adjacent wall elements connected to one another, the wall elements comprising elongate cylindrically shaped members. The method also includes the step of positioning at least one roof support at a top of at least one of the walls, and forming a roof extending over at least a portion of a space between the at least two walls, the roof comprising a plurality of generally planar slats, one or more of the slats mounted upon the at least one roof support, whereby a play structure is created having a generally enclosed interior within which a child may play, the generally enclosed interior defined by the at least two upwardly extending walls and the roof.

Other methods of constructing a play structure vary depending on the configuration of the building elements and the structure which is being constructed.

Further objects, features, and advantages of the present invention over the prior art will become apparent from the detailed description of the drawings which follows, when considered with the attached figures.

DETAILED DESCRIPTION OF THE INVENTION

The invention is a play structure, a method of assembling a play structure, and one or more building elements from which a play structure may be constructed. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention comprises a plurality of structural building element which a child may use to create a play structure. Other aspects of the invention comprise a kit of elements which may be used to construct a structure, a method of assembling a play structure, and a complete play structure.

Figure 1:
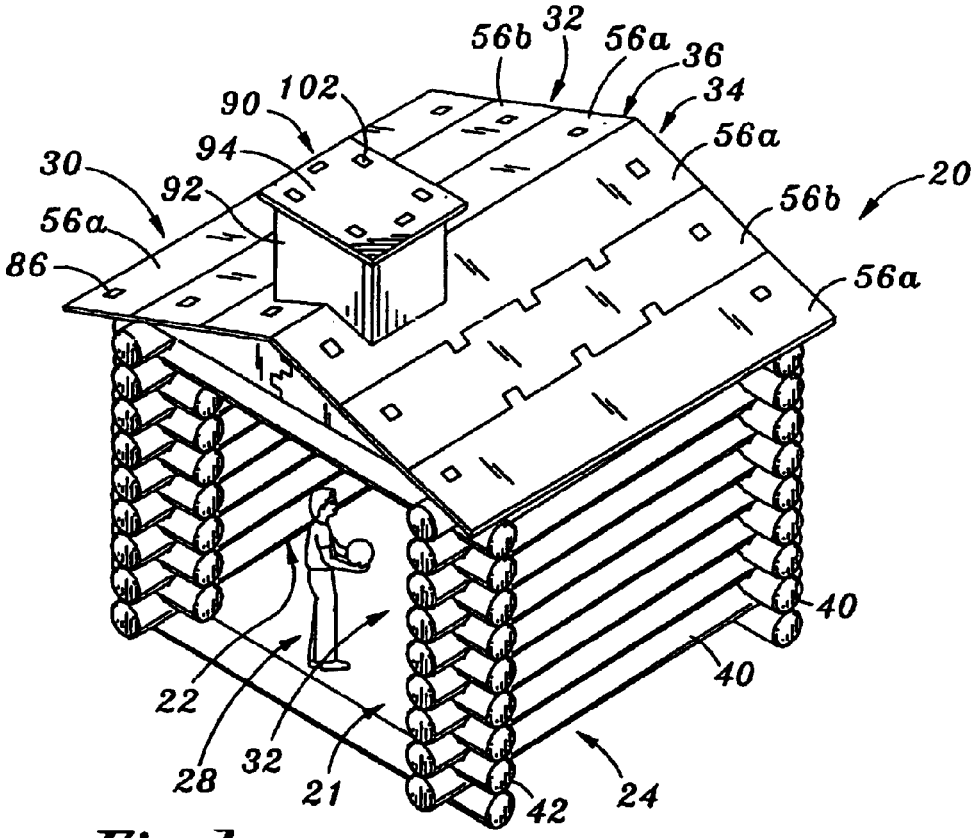
FIG. 1 is a perspective view of a play structure in accordance with one embodiment of the invention.

FIG. 1 illustrates a play structure 20 in accordance with one embodiment of the invention. As illustrated, the assembled play structure 20 has the form and appearance of a log cabin. As described in more detail below, the play structure of the invention may have a variety of other forms, such as the form and appearance of a castle, igloo, fire station or the like.

In general, the play structure 20 has one or more supporting and enclosing walls, and a roof. In this manner, the structure 20 defines at least a partially enclosed area within which a child may play.

The embodiment play structure 20 illustrated in FIG. 1 has three walls and a roof structure. The structure 20 includes a pair of opposing side walls 22,24. The side walls 22,24 are spaced apart from one another. The side walls 22,24 are connected at one end by a rear wall 26 (see FIG. 2). An opening or door 28 is defined between the side walls 22,24 at a front end of the structure 20 opposite the rear wall 26. As illustrated, in one embodiment, the side walls 22,24 at the front end of the structure 20 are connected at the top and bottom by at least one spanning element.

The size of the structure 20 may vary. In one embodiment, the side walls 22,24 are each about 5 feet long. The rear wall 26 is similarly about 5 feet wide, such that the structure has a footprint of about 5 feet by 5 feet. The structure 20 may be larger or smaller. The height of the side walls 22,24 and rear wall 26 may also vary. In one embodiment, the height of the side and rear walls 22,24,26 is the same, about 3 feet. As will be detailed below, the interior height of the play structure 20 is larger than the wall height due to the shape of the roof.

As indicated, the play structure 20 preferably includes a roof 30 which cooperates with the walls to define a generally enclosed area 32. In one embodiment, the roof 30 has the form and appearance of a gabled sloped roof. As such, the roof 30 has a pair of opposing sections 32,34 which slope downwardly from a ridge-line or crown 36. As illustrated, the ridge-line or crown 36 is preferably centrally located, extending along the length of the play structure 20 mid-way between the side walls 22,24.

In one embodiment, the roof 30 is sized to overhang the walls 22,24,26. The roof 30 is raised above the walls 22,24,26, so that the height of the interior of the play structure 20 is higher than the walls 22,24,26. In one embodiment, the maximum height of the play structure 20 is approximately 20 inches more than the top of the walls 22,24,26. Of course, the roof height may vary. For the same size structure, a higher roof will result in a steeper roof pitch, and a low roof height will result in a less steeply pitched roof. A steeper roof pitch may be used, for example, to create a different appearance such as an "alpine" look.

Preferably, the play structure 20 is of a modular construction. In particular, the play structure 20 is constructed from a plurality of structural elements, the structural elements capable of being connected and disconnected from one another.

Figure 3:
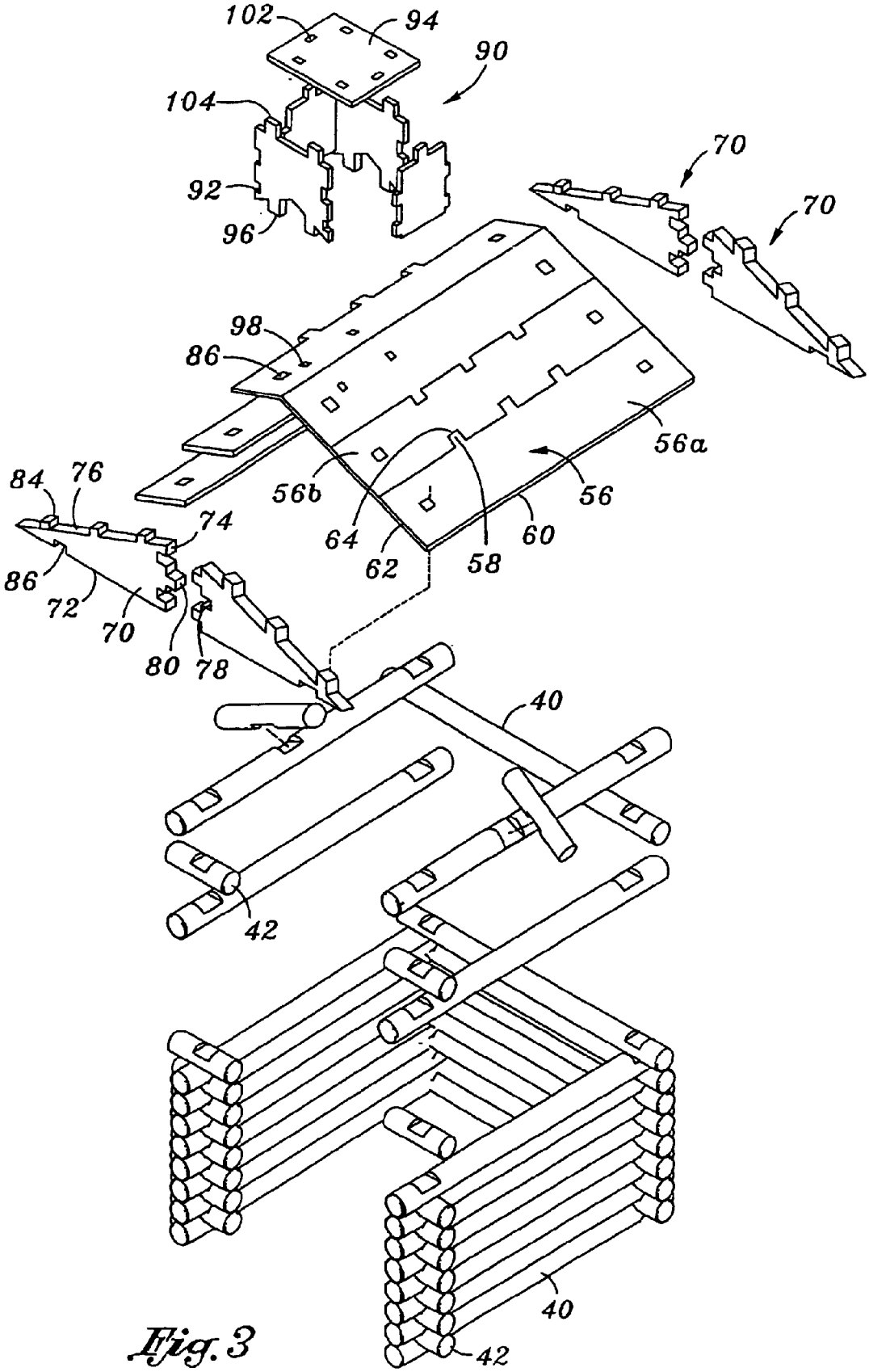
FIG. 3 is an exploded assembly view of the play structure illustrated in FIG. 1.

FIG. 3 illustrates one configuration of structural elements for generating the play structure 20 illustrated in FIG. 1. As illustrated in FIG. 3, the side and rear walls 22,24,26 are constructed from a plurality of stacked wall elements 40. In one embodiment, these wall elements 40 comprise elongate members. The members may have a variety of shapes and sizes. When forming a log cabin play structure 20, the elongate members preferably have the shape of a log, and are thus rod or cylinder-shaped. In one embodiment, the wall elements 40 are about 60 inches long and have a diameter of about 2–8 inches, and most preferably about 4 inches.

Means are preferably provided for retaining the wall elements 40 in their stacked position. In one embodiment, this means comprises interlocking notches or other elements formed in or on the wall elements 40.

In another embodiment, this means comprises a separate element, namely an interlocking link 42. In one embodiment, means are provided for connecting the otherwise separate interlocking links 42 with the wall elements 40. This means may also comprise interlocking notches or other elements formed in or on the wall elements 40 and interlocking links 42. In one embodiment, the interlocking links 42 are about 12 inches long and 4 inches in diameter.

Figure 6:
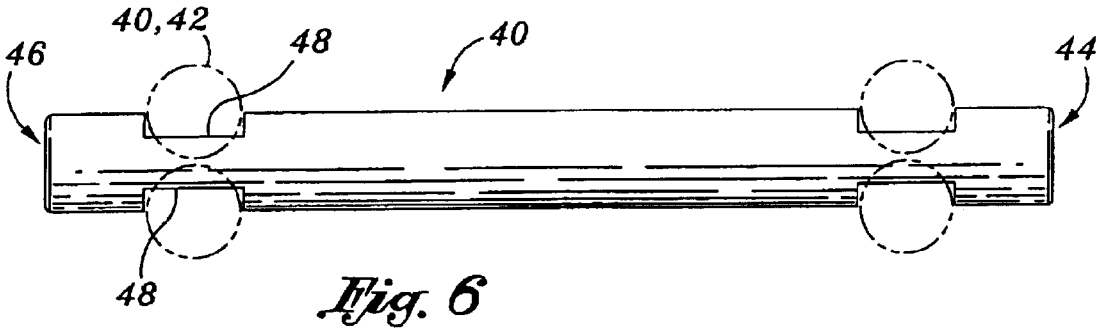
FIG. 6 illustrates another structural element in accordance with the invention.

Referring to FIGS. 3 and 6, the wall elements 40 preferably have a first end 44 and a second end 46. At least one notch 48, and preferably a pair of notches, are formed in each wall element 40. As illustrated, each notch 48 defines a recessed area in the wall element 40, the recessed area defining a generally planar area.

In one embodiment, a pair of notches 48 are located at each end 44,46 of each wall element 40. Preferably, the notches 48 are positioned opposite one another, or 180 degrees from one another around the wall element 40 when the wall element is rod-shaped.

Figure 4:
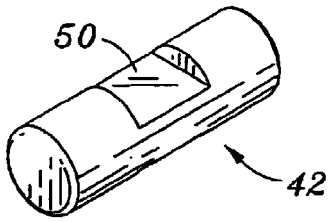
FIG. 4 is a perspective view of a structural element in accordance with one embodiment of the invention from which a play structure of the invention may be constructed.
Figure 5:
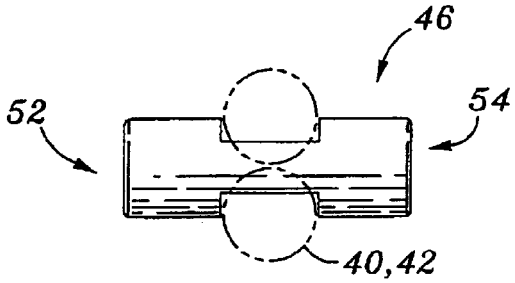
FIG. 5 illustrates the interconnection the structural element illustrated in FIG. 4 with other structural elements.

Referring to FIGS. 3–5, the interlocking links 42 preferably include one or more mating notches 50. In one embodiment, the interlocking links 42 also have a first end 52 and a second end 54. In one embodiment, each interlocking link 42 includes a pair of notches 50 positioned generally mid-way between the ends 52,54 of the link 42. Like the wall elements 40, the notches 50 in the interlocking links 42 are preferably located opposite one another.

Referring to FIG. 3, the means for connecting permits the wall elements 40 to be connected when they are oriented in at least one position. In particular, the wall elements 40 may be connected directly to one another when they are oriented 90 degrees are generally perpendicular to one another. This configuration permits, as illustrated in FIG. 3, the wall elements 40 of the side walls 22,24 to be connected to the wall elements 40 of the rear wall 26.

Also referring to FIG. 3, use of an interlocking link 42 permits the pairs of wall elements 40 which are oriented parallel to one another to be connected. As illustrated, the interlocking link 42 is positioned between, and generally perpendicular to, the wall elements 40. The notches 52 in the interlocking link 42 each engage a mating notch 48 formed in the wall element 40.

The notches 48,50 may have a variety of shapes and sizes. For example, the depth of the notches 48,50 may vary. In one embodiment, the depth of the notches 48,50 is chosen so that when interconnected, there is little space between stacked wall elements 40. The width of the notches 48,50 may vary. Preferably, however, the width of the notches 50 in the interlocking links 42 varies from the notches 50 in the wall elements 40, it being appreciated that if the notches 48,50 were the same size, there would be an interference preventing the interlocking links 42 and wall elements 40 from joining.

The means for connecting the interlocking links 42 and wall elements 40 may be other than mating notches as illustrated. For example, the interlocking links 42 might engage the wall elements 40 in a mating tooth or pin and groove arrangement.

In another embodiment, the means for connecting the wall elements 40 might comprise other than interlocking links 42. For example, the wall elements 40 might engage one another directly, such as by a tooth or pin and groove arrangement.

One advantage of the configuration of the invention utilizing interlocking links 42 is that the assembled structure matches the appearance of a true log cabin structure.

Preferably, the roof 30 also has a modular construction. One embodiment of a configuration for the roof 30 is illustrated in FIG. 3. As illustrated, the roof 30 comprises a plurality of roof slats 56. In one embodiment, each slat 56 comprises a generally flat or planar member. Each slat 56 preferably spans the entire length of the play structure 20. The slats 56 are narrow, however, such that a plurality of slats 56 must be positioned side by side to form the roof width-wise. As illustrated, the roof 30 is constructed of 6 slats 56. The roof 30 may be constructed from a greater or lesser number of slats 56.

The roof slats 56 or other elements may have a variety of other configurations. For example, the roof slats 56 need not be planar or generally rectangular in shape. For example, the roof elements may also be generally rod-shaped. The generally planar slat shape is preferred as it is consistent with the construction and appearance of the roofs of actual log cabin structure.

Means are preferably provided for connecting the individual slats 56 to form a unitary roof structure. In one embodiment, this means comprise interlocking portions of the slats 56. As illustrated in FIG. 3, the slats 56 are connected using a tooth and notch configuration.

In one embodiment, as illustrated in FIG. 3, four slats 56*a* which comprise the roof 30 have a plurality of teeth 58 extending from one side thereof. As illustrated, these slats 56*a* have a pair of elongate sides 60 and a pair of shorter ends 62. As illustrated, three teeth 58 extend outwardly from one of the elongate sides 60. The teeth 58 are spaced apart from one another.

Two slats 56*b* are configured to mate with the other slats 56*a*. These slats 56*b* have mating notches 64 formed therein. These slats 56*b* also have elongate sides 60 and shorter ends 62. Each of the elongate sides 60 has notches 64 corresponding to the teeth 58 of one of the other slats 56*a*. As illustrated, there are three teeth 58 for mating with three corresponding notches 64. There may, however, be greater or lesser number of teeth and mating notches.

In this arrangement, each side, or section 32, and 34 of the roof 30 comprises one of the notched slats 56*b* positioned between a pair of the toothed slats 56*a*. As illustrated, the elongate side 60 of the toothed slats 56*a* which do not bear the teeth are oriented to form an outer edge of the roof 30 and a part of the crest-line of the roof 30. In this manner, the three assembled slats 56*a,b* form an assembled roof half having straight edges. Likewise, the other half, or section of the roof is similarly constructed.

The roof 30 may be constructed of elements having other shapes and configurations. For example, depending on the size of the roof 30, the roof may be constructed of a greater number of assembled slats. In such a configuration, other configurations of mating notches and teeth may be used to connect the slats.

Preferably, the roof 30 is connected to the walls 22,24,26 of the play structure 20. In this manner, the roof 30 is stable and does not slide off of the walls 22,24,26. In addition, the roof 30 is preferably connected in a manner by which the roof 30 is supported with a raised crest or crown 36.

As illustrated in FIG. 3, means are provided for connecting the roof 30 to the walls 22,24,26 of the play structure 20. In one embodiment, this means comprises one or more roof supporting gables or end supports 70.

Referring to FIG. 3, in one embodiment there are four roof gables 70. Each gable 70 is generally triangular shaped. Each gable 70 has a bottom edge 72, a side edge 74, and a top edge 76 which slopes from the side edge 74 down to the bottom edge 72.

As illustrated, means are provided for connecting pairs of gables 70 to form a single end support. As illustrated, this means comprises an interlocking tooth and notch. One gable 70 of the pair has a notch 78 formed in the side edge 74, while the other gable 70 has a mating tooth 80 extending from the side edge 74.

The gables 70 are preferably generally planar. In one embodiment, the single end support may comprise a single specially configured gable. The illustrated embodiment as the advantage of reducing the size of the building elements and increasing the number of elements which must be assembled to construct the playhouse 20.

Means are provided for connecting the gables 70 to the walls 22,24 of the play structure 20. In one embodiment, coupled gables 70 forming a front end support are connected to the side walls 22,24 at the front end thereof.

In one embodiment, this means comprises a notch 82 formed in the bottom edge 72 of each gable 70. The notch 82 is sized and shaped to engage a mating notch 48 in a wall element 40.

Likewise, the gables 70 used to form a rear end support are similar configured.

Means are provided for connecting the roof 30 to the gables 70 forming the front and rear end roof supports. In one embodiment, this means again comprises a mating tooth or pin and notch. As illustrated, each gable 70 includes one or more teeth or pins 84 extending outwardly from the sloping top edge 76. As illustrated, each gable 70 includes three teeth or pins.

Each roof slat 56 includes a pair of mating notches or opening 86. As illustrated, one notch or opening 86 is formed near each end 62 of each slat 56. The opening 86 is adapted to accept a mating tooth or pin.

In this configuration, each slat 56 is connected at both of its ends directly to one of the gables 70, as well as the other slats 56. This serves to secure the roof 30 to the gables 70.

The play structure 20 may include a variety of other features, including aesthetic features. For example, as illustrated in FIG. 1, the play structure 20 may include a simulated chimney 90. In one embodiment, as illustrated in FIG. 3, the chimney 90 is of a modular construction.

In one embodiment, the chimney 90 has four walls 92. The four walls 92 may be connected and disconnected from one another. When connected, they form a generally square or rectangular perimeter. In one embodiment the four walls 92 are connectable by engaging mating teeth and grooves.

The walls 92 of the chimney 90 are also connectable to the roof 30. As illustrated, two of the walls 92 include downwardly extending pins 96 for engaging mating apertures 98 formed in the roof slats 56. In the embodiment illustrated, only two of the roof slats 56 have the apertures 98. In another embodiment, to permit interchangeability the locations of the slats 56, all of the slats may include the apertures 98.

In one embodiment, the chimney 90 includes a top 94. In one embodiment, the top 94 is connected to the four walls 92. As illustrated, the top 94 includes a plurality of apertures 102 for accepting pins 104 which extend upwardly from the walls 92. In another embodiment, the top 94 may be mounted inside of the four walls 92, instead of on top of the four walls. In such an arrangement, the top 94 is positioned within the interior space defined by the four walls 92, and is not visible, giving the chimney a similar appearance to a real chimney, but also preventing things from being deposited into the space defined by the walls 92.

The play structure 20 may include other features. For example, the structure may include windows, doors, etc. The open end may be enclosed or may include a door. The otherwise closed end may be opened.

Figure 2:
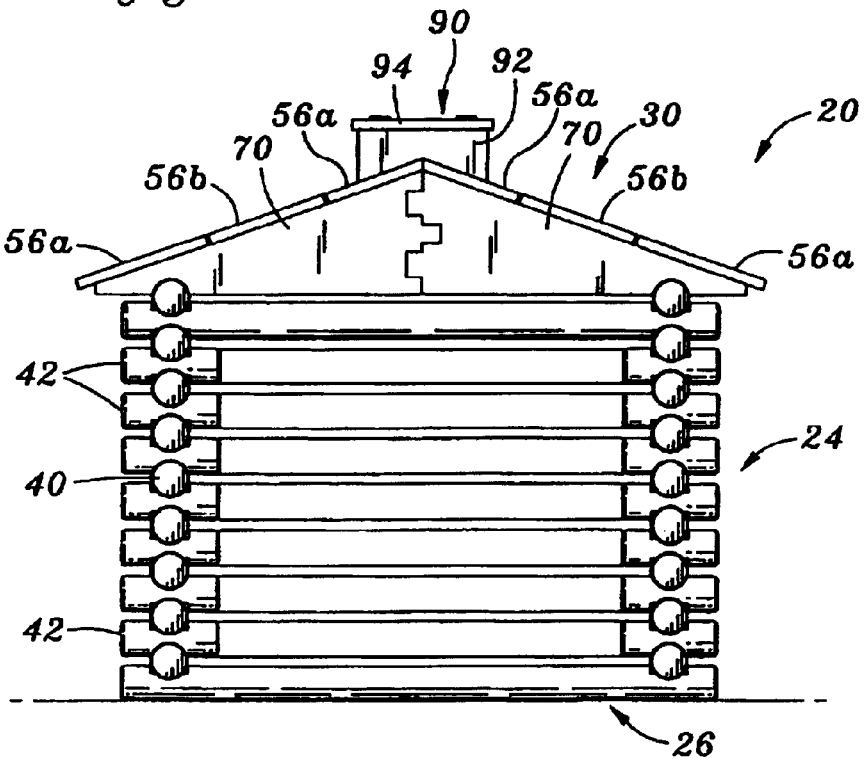
FIG. 2 is an end view of the play structure illustrated in FIG. 1.
Figure 7:
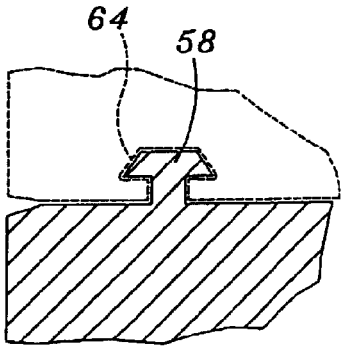
FIG. 7 illustrates one embodiment of an interconnecting tooth and notch for mating elements in accordance with one embodiment of the invention.

The mating teeth/pins and notches of the elements of the invention may have several forms. In one embodiment, as illustrated in FIGS. 1–3, the teeth are generally rectangular extensions which mate with rectangular shaped cut-outs or notches in mating elements. As illustrated in FIG. 7, the teeth may have a "T" shape. In one embodiment, a tooth may have a body which extends outwardly to a head. In one embodiment, as illustrated, the head has a pair of sides which slope, such that the head has the form of a trapezoid. This embodiment tooth and mating notch configuration has the advantage that the tooth can not simply be pulled or slipped from the notch in the plane of the element (as opposed to the configuration illustrated in FIG. 1). Instead, the tooth can only be disengaged by moving the tooth out of the plane in which the notch is positioned. This tooth and notch configuration can be applied to the various mating elements described above, including the roof and chimney elements. For example, the tooth may be the tooth 58 of the roof element and the notch the notch 64 of the roof element illustrated in FIGS. 1–3.

As indicated above, the size of the assembled play structure 20, as well as the individual building elements or components thereof, may vary. This principle applies generally to the invention, including other structures and components. For example, while the wall elements 40 may be 5 feet long, they may be longer or shorter, as desired. The size of the individual components and the assembled structure may be varied dependent upon a number of factors. Preferably, the size of the individual components is selected so that they may be handled by a small child, and thus are preferably not too large. The weight of the component plays a large factor in determining the maximum desired size of the component. In addition, other factors such as the shipping and storage of the components may be considered.

It is also preferred that the assembled structure be large enough to permit a child to play inside the structure, and thus it is desirable but not mandatory that the structure be several feet high, wide and deep. The size of the assembled structure may be selected based in part upon the age or age group of children for which the structure is designed, the structure generally being designed to be larger for older children. Of course, if the individual components are selected to be very small, a greater number of the components may be needed to assemble a structure of a particular size.

One aspect of the invention is a method of assembling or constructing a play structure, such as the cabin-type play structure illustrated in FIGS. 1–3. In accordance with the method, the structure 20 may be assembled from its individual elements, and may be disassembled into its individual elements.

As illustrated in FIG. 3, in accordance with the method, wall elements 40 are arranged to form the base of the side walls 22,24. A wall element 40 is connected to those element to form the base of the rear wall 26. Wall elements 40 are then stacked upon the base wall elements to complete the side and rear walls 22,24,26. As illustrated, one end of each wall element forming the side walls 22,24 is connected directly to the wall elements 40 forming the rear wall 26. The other end of each wall element forming the side walls 22,24 is connected to another wall element by an interlocking link 42.

As illustrated in FIGS. 1 and 2, a wall element 40 may span the front end of the structure 20, connecting the side walls 22,24. As illustrated, a wall element 40 may be located at the bottom and top of the front end of the structure 20, connecting the side walls 22,24. As illustrated in FIG. 3, such a spanning link need not be provided. However, the method of assembly illustrated in FIGS. 1 and 2 has the advantage that the side walls 22,24 at the front end of the structure 20 are maintained in their desired positions and are not easily moved towards or away from one another. As may be appreciated, such movement, such as by a child pressing upon the side walls 22,24 could change the distance between the walls and thus remove the support from the roof 30.

Once the walls 22,24,26 are assembled, the roof 30 may be attached. In one embodiment, the end supports or gables 70 are connected to the walls 22,24,26. The roof slats 56 are then connected to the end supports or gables 70 and to one another, as illustrated.

As illustrated in FIG. 3, a pair of links 42 may be connected to the top-most wall element 40 of each side wall 22,24. In this regard, at least one pair of the wall elements 40 may include a notch located between its ends. In one embodiment, the notch is offset or angled, as is the notch in the mating links 42. The links 42 are connected to the wall elements 40 and extend under the roof 30, supporting the roof along the top of the side walls 22,24 between the ends of the side walls. As indicated, these links 42 may be configured to mount and extend upwardly at an angle matching the slope of the roof 30.

Once the roof 30 is complete, the chimney 90 may be assembled and attached thereto.

When assembled, a play structure may be created as illustrated in FIG. 1. It will be appreciated that a child may use the individual building elements to form other structures. These structures may or may not be exactly as illustrated in FIG. 1, and may have little resemblance to common building structures.

In accordance with the method, the structure 20 may also be disassembled into its basic building elements, such as individual roof slats 56, wall elements 40 and interlocking links 42. In this configuration, the structure 20 may easily be stored.

One aspect of the invention is a structural building element for constructing a play structure. Various embodiments of building elements are contemplated. As illustrated in FIGS. 3–6, the building elements may comprise interlocking links 42, elongate wall elements 40, roof slats 56 and other elements. As described above, the shape and size of these elements may vary. The elements may include various means for connecting them to other elements, such as notches, grooves, teeth and pins.

Preferably, one embodiment of a building element comprises a member constructed from polyethylene. The manner by which each building element is manufactured may vary. In a preferred embodiment, each generally cylindrical wall element 40 and interlocking link 42 is constructed of extruded, expanded polyethylene.

In this embodiment, an elongate cylindrically shaped polyethylene member is extruded. The member may be cut into desired lengths. The notches or other features may be formed into each member. For example, the notches in a length of extruded polyethylene may be formed by machining, such as by using a cutting device to remove a portion of the member to form the notch.

The building elements may be formed in other manners as well. In a preferred embodiment, generally planar members such as the roof slats 56, chimney walls 92 and the like are preferably formed from polyethylene as well, but may not be extruded but may be vacuum formed.

Building elements in accordance with the invention may be used to construct other structures. For example, structures such as igloos, fire stations, castles and others may be constructed. In fact, in accordance with the invention the variety of structures which may be assembled from particularly configured components is endless. The exact shape of the building elements may vary depending on the structure. For example, an igloo may be constructed of interlocking curved, but generally planar, panels. A castle may be constructed of interlocking block-shaped elements. Of course, in some instances, components which are utilized to assemble a structure may be used in the assembly of another structure, reducing the cost of manufacturing the components needed to form the various structures, and also the number of components a consumer may need to purchase and store.

One embodiment of the invention comprises a "kit" of components. Preferably, the kit comprises a grouping of a plurality of components which may be assembled into at least one particular structure. In accordance with another embodiment, other kits may comprise groupings of components which may be assembled into more than one structure or which may be added to another assembled structure to increase its size or change its form. For example, one kit may be used to assemble a castle structure. Another kit may be used to add a particular tower to the base castle structure. In a preferred embodiment, the structures are configured so that they may be joined (i.e. interlock or connect), increasing their stability.

There are numerous particular advantages of the building elements of the present invention. The building elements constructed from polyethylene are very durable. The building elements may be folded, bent, or crushed, and will not break. In fact, the elements so constructed have a "memory" which causes the building element to spring back to its original shape.

Another advantage of the building elements is that they are lightweight. In the preferred configuration, the building elements may be 6 feet long or longer. In order to permit a child to handle the building elements, they must be lightweight. Building elements so constructed may only weigh a few pounds, and thus can be picked up and moved by even the smallest children.

The building elements are safe. Because it is intended that children use the building elements, it is of utmost importance that the building elements not pose a risk of injury or harm to the children who use them. As indicated, because the building elements are light-weight the risk of injury is substantially reduce, since if the building elements fall, are thrown, swung or the like, they are so lightweight that little force can be transmitted to the child if they are hit. In addition, the polyethylene material is flexible, so that the material have a soft impact.

Yet another advantage of the building elements is that they are very durable. When extruded or otherwise formed, the building elements are of a solid (i.e. not hollow) construction. This solid construction makes the building elements very durable. The polyethylene material also is resistant to tearing. The building elements are also weather resistant and do not break down when exposed to sunlight or even water. For example, the building elements will not rot if left in the rain.

Another advantage of the building elements is that they are maintenance free. For example, they need not be painted to protect them from the rain. The building elements can also easily be cleaned by vacuuming them, or preferably, by washing them off with water. For example, the elements may be cleaned by spraying them with a hose.

Another advantage of the building elements is that they may easily be formed in a variety of colors. Dye may be added to the polyethylene material during the manufacture. In the case of the cabin structure illustrated in FIG. 1, the wall elements may be made brown and the roof elements made red. In the case of an igloo, the natural color of the polyethylene is white, matching the color of snow/ice.

The building elements may also be constructed in a variety of shapes, including complex shapes. For example, the building elements may be constructed with complex curves and comers.

It will be appreciated that these advantages are numerous when considering other types of building elements. For example, real wood elements are heavy, subject to deterioration, must be painted to change their color, and can not be formed into some complex shapes. Other materials, included molded ABS plastic is also heavy, may shatter or break, and may discolor when exposed to the elements.

The structures of the present invention have numerous advantages over existing play structures. First and foremost, a play structure is provided which can be assembled by a child. As described, the individual building elements of the structure are lightweight and safe, and may easily be handled by even small children.

The building elements are easily assembled or connected. In the embodiment illustrated in FIG. 3, the building elements are easily connected by interlocking mating notched portions or mating teeth or pins with notches/apertures. The manner of connection requires no tools, adhesives or other external elements.

One advantage of the structure is that it is composed of a plurality of basic building elements. Because it is comprised of a substantial number of building elements, the building elements are small enough to be handled by a child. In addition, however, the child is challenged to utilize and connect the elements to form the completed structure. At the same time, because many of the elements are similar, much of the construction is based upon repetition of a developed skill. For example, one the child learns how to connect a wall element 40 with an interlocking link 42, this skill may simply be repeated to complete construction of the walls of the structure. The invention may be considered a three-dimensional puzzle. In particular, a variety of elements are configured to interlock or connect, and when connected properly, form a desired structure in three-dimensions.

The structure may be used indoors or outdoors. As indicated, the building elements are weatherproof, and thus the structure may be used outdoors. The "soft" construction of the structure also allows the structure to be assembled and used indoors without risk of damage to furniture, carpeting and other objects.

The structure may easily be stored when not in use. As indicated, the structure may be disassembled. In its disassembled form, the structure occupies little space. The individual building elements may be stored in a group, such as in a box, or may be stored individually in a variety of locations. Again, because the building elements are weather-resistant, they may be stored indoors or outdoors. Because the elements are lightweight, they also may be stored on shelves, attics or other locations where heavy items may not be stored.

It will be understood that the above described arrangements of apparatus and the method therefrom are merely illustrative of applications of the principles of this invention and many other embodiments and modifications may be made without departing from the spirit and scope of the invention as defined in the claims.

What is claimed is:

1. Structural building elements for use in building a play structure from a plurality of said structural building elements, said structural building elements comprising:

an expanded polyethylene building element of substantially cylindrical shape, said cylindrical element including at least one interlocking notch permitting connection of said cylindrical element to another cylindrical element by interlocking corresponding notches of said elements oriented lengthwise perpendicular to each other;

an expanded polyethylene building element of substantially planar panel shape, said planar element including at least one interlocking link permitting connection of said planar element to another planar element, and at least one aperture;

an expanded polyethylene building element of substantially triangular panel shape, said triangular shape having at least one acute angle, said triangular element including at least one interlocking link and one interlocking link notch permitting connection of said triangular element to another triangular element by insertion of interlocking link into interlocking link notch, at least one interlocking notch permitting connection of said triangular element to said cylindrical element by interlocking notch of triangular element with corresponding notch of cylindrical element oriented perpendicular to each other, and one tooth extending outward permitting connection of said triangular element with a planar element by insertion of said tooth into aperture in said planar element;

an expanded polyethylene building element of substantially cylindrical shape, said cylindrical element including at least one interlocking notch permitting connection of said cylindrical element to another cylindrical element by interlocking corresponding notches of said elements oriented lengthwise perpendicular to each other one or more end notches, and one or more intermediate notches at an acute angle offset from the end notches, said angle corresponding to one of the acute angles of the triangular panel element, said intermediate notches permitting connection with another cylindrical element by interlocking corresponding notches of said cylindrical elements oriented lengthwise perpendicular to each other, and an expanded polyethylene building element of substantially square panel shape, said square element including at least one interlocking link and one interlocking link notch permitting connection of said square element to another square element by insertion of interlocking link into interlocking link notch, and at least one tooth extending outward permitting connection of said square element with a planar element by insertion of said tooth into aperture in said planar element.

2. The structural building elements in accordance with claim 1 wherein said elements are extruded.

3. The structural building element in accordance with claim 1 wherein each said element is colored in accordance with its element type according to a predetermined color scheme.

4. A play structure which may be constructed from a plurality of building elements comprising:

a plurality of wall elements, said wall elements comprising generally elongated cylindrical elements, said elements comprising extruded polyethylene, having one or more interlocking notches and connectable to form at least two upstanding walls of a structure by interlocking corresponding notches of said elements oriented lengthwise perpendicular to each other;

a plurality of roof elements, said roof elements comprising generally elongated rectangular planar elements, said elements comprising extruded polyethylene and said roof elements interconnectable to form a roof;

a plurality of roof support elements, said roof support elements comprising generally triangular planar elements having at least one acute angle, said roof support elements comprising extruded polyethylene and said roof support elements connectable to produce an expanded triangular element connected to said roof elements to support said roof above said walls;

a plurality of chimney elements, said chimney elements comprising generally square planar elements, said chimney elements comprising extruded polyurethane and said chimney elements interconnectable to form a cube-shaped chimney and connectable to said roof elements to sit atop said formed roof;

at least one topmost side wall element, said element comprising generally elongated cylindrical element, said element comprising extruded polyethylene and connectable to become the topmost element of an upstanding wall of a structure, said element comprising end notches and one or more intermediate notches, at an acute angle offset from the end notches, said angle corresponding to one of the acute angles of said roof support element, said intermediate notches connectable with another cylindrical element; and a plurality of interlocking elements, said interlocking elements comprising cylindrical elements, said elements comprising extruded polyurethane, having one or more pair of diametrically opposed interlocking notches and connectable to one or more said wall elements to retain two or more such wall elements in adjacent parallel position, and connectable to said topside wall elements at an ascending angle to form an intermediate support for said roof elements;

whereby a play structure may be created having upwardly extending walls supporting a roof, said walls and roof defining an interior area of said structure within which a person may enter.

5. The play structure in accordance with claim 4 having means for connecting one or more of said roof slats comprises at least one interlocking tooth extending from one roof slat for engagement with at least one interlocking notch formed in another roof slat.

6. The play structure in accordance with claim 4 further comprising means for connecting said roof elements to said roof support elements having at least one tooth extending outward from at least one of said roofs support elements for engagement with at least one aperture formed in one of said roof elements.

7. The play structure in accordance with claim 4 wherein said play structure has three walls formed from said wall elements, said walls comprising a pair of spaced side walls and a single end wall, said side walls extending generally perpendicular to said end wall, and a front construction comprising a single wall element at the lowest level and interlocking elements at ascending levels, said wall element and interlocking elements cooperating to provide structural support and shape retention.

8. The play structure in accordance with claim 4 wherein said roof element include at least four main roof slats each having a pair of sides and a pair of ends, said pair of ends sides and one of said sides being generally straight, and the other of said sides including at least one element for connecting said roof slats to a connecting roof slat, and at least a pair of connector roof slats, each having a pair of sides and a pair of ends, for each said connector roof slat said ends being generally straight and both of said sides including at least one element for connecting said connector roof slat to a main roof slat.

9. The play structure in accordance with claim 8 wherein at least one element of said main roof slat comprises at least one outwardly extending pin.

10. The play structure in accordance with claim 9 wherein at least one element of said connector roof slat comprises at least one notch for accepting said pin.

11. A method of constructing a play structure comprising;

forming at least two upwardly extending walls, each said upwardly extending wall formed from a plurality of wall elements arranged vertically, adjacent wall elements including end notches and connecting to one another through said end notches, said wall elements comprising elongated cylindrically shaped elements;

positioning at least one topmost wall element as the highest element on at least one of said formed walls, said topmost wall element including one or more end notches and one or more intermediate notches at acute angle offset from said end notches, said angle corresponding to one of said acute angles of said triangular panel element;

positioning at least one pair of roof supports atop at least one said walls and connecting said roof supports to said wall elements at the end notches of said wall element;

positioning at least one intermediate roof support atop at least one said wall, said intermediate roof support interconnected with said topmost wall element at an intermediate notch; and forming a roof extending over at least a portion of a space between said at least two said walls, said roof comprising a plurality of generally planar elements, one or more of said planar elements mounted upon at least one said roof support and one or more said intermediate roof support cooperating with said roof support to support said planar elements, whereby a play structure is created having a generally enclosed interior within which a person may enter, said generally enclosed interior defined by at least two said upwardly ascending walls and said roof.

12. The method in accordance with claim 11 wherein said wall elements have at least one end having a notch formed therein and said adjacent wall elements are connected to one another by positioning an interlocking element between them, said interlocking element having a pair of opposing notches for engagement with said notches on the ends of said adjacent wall elements.

13. The method in accordance with claim 11 including the step of forming a pair of opposing side walls having a first end and a second end, and at least one end wall, connecting two pair of said roof supports together to form a front expanded triangular roof structure, and a rear expanded triangular roof structure; and the step of connecting said front expanded triangular roof structure to said first end of said side walls, and said rear expanded triangular roof structure to said second end of said side walls.

14. The method in accordance with claim 13 wherein said step of forming said roof comprises connecting opposing ends of each element with said front and rear expanded triangular roof structure.

15. The method in accordance with claim 14 wherein said front and rear expanded triangular roof structures are generally triangular in shape, having a first sloping edge and a second sloping edge and a plurality of elements are supported by said first sloping edge of said front and rear expanded triangular roof structures and define a first downwardly extending roof portion and said plurality of elements are supported by said second sloping edge of said front and rear expanded triangular roof structures and define a second downwardly extending roof portion, and including the step of connecting said roof elements to one another to form a first roof portion, and connecting said roof elements to one another to form a second roof portion, and connecting said first roof portion to said first front and rear sloping edges and connecting said second roof portion to said second front and rear sloping edges.

* * * * *